US008327790B2

(12) United States Patent
Snow

(10) Patent No.: US 8,327,790 B2
(45) Date of Patent: Dec. 11, 2012

(54) TRIM TAB

(75) Inventor: Scott Snow, Commerce, MI (US)

(73) Assignee: Marine I, LLC, New Baltimore, MI (US)

( * ) Notice: Subject to any disclaimer, the term of this patent is extended or adjusted under 35 U.S.C. 154(b) by 90 days.

(21) Appl. No.: 12/547,299

(22) Filed: Aug. 25, 2009

(65) Prior Publication Data

US 2010/0043691 A1 Feb. 25, 2010

Related U.S. Application Data

(60) Provisional application No. 61/091,451, filed on Aug. 25, 2008.

(51) Int. Cl.
*B63B 1/22* (2006.01)

(52) U.S. Cl. ..... 114/285

(58) Field of Classification Search ..... 114/284–286
See application file for complete search history.

(56) References Cited

U.S. PATENT DOCUMENTS

| | | | | |
|---|---|---|---|---|
| 5,310,369 | A * | 5/1994 | Kobayashi | 440/38 |
| 5,881,666 | A * | 3/1999 | Crews, Jr. | 114/285 |
| 6,524,146 | B2 * | 2/2003 | Spade et al. | 440/41 |
| 7,174,843 | B1 | 2/2007 | Tossavainen | |

FOREIGN PATENT DOCUMENTS

| | | |
|---|---|---|
| JP | 06-037200 | 5/1994 |
| JP | 07-165185 | 6/1995 |
| JP | 2001-294197 | 10/2001 |

* cited by examiner

*Primary Examiner* — Daniel Venne
(74) *Attorney, Agent, or Firm* — Gifford, Krass, Sprinkle, Anderson & Citkowski, P.C.

(57) ABSTRACT

A trim tab assembly for a watercraft includes a enclosure. A support structure is positioned in the enclosure. At least one trim tab is disposed in the enclosure. The trim tab includes a generally planar top, bottom, side and front surfaces linked by a curved surface defining a wedge shaped body. An actuator is linked to the trim tab pivotally moving the trim tab relative to the enclosure.

16 Claims, 8 Drawing Sheets

TRIM TAB

CROSS-REFERENCE TO RELATED APPLICATIONS

This application claims priority of U.S. Provisional Application No. 61/091,451 filed Aug. 25, 2008 which is incorporated herein by reference.

FIELD OF THE INVENTION

The invention relates to trim tabs for marine vessels.

BACKGROUND OF THE INVENTION

Generally current prior art trim tabs may be attached to a vessel on an outside of the hull. Prior art trim tabs do not move at a rate sufficient to dampen motion of a vessel. Prior art trim tabs typically require running lines and hoses through the hull to actuate the trim tabs. Additionally current trim tabs may require bulky actuators that are not easily integrated into a vessel. Further current trim tabs may require large forces to actuate the tabs. There is therefore a need in the art for an improved trim tab that is easily integrated into a vessel and solves the problems of the prior art.

SUMMARY OF THE INVENTION

In one aspect there is disclosed a trim tab assembly for a watercraft that includes a enclosure. A support structure is positioned in the enclosure. At least one trim tab is disposed in the enclosure. An electric actuator is linked to the trim tab pivotally moving the trim tab relative to the enclosure. The electric actuator is positioned on a dry side relative to the enclosure.

In another aspect, there is disclosed a trim tab assembly for a watercraft that includes a enclosure. A support structure is positioned in the enclosure. At least one trim tab is disposed in the enclosure. The trim tab includes a generally planar top, bottom, side and front surfaces linked by a curved surface defining a wedge shaped body. An actuator is linked to the trim tab pivotally moving the trim tab relative to the enclosure.

DETAILED DESCRIPTION OF THE PREFERRED EMBODIMENTS

Differential and differentially are defined within this document as unequal, off center and/or involving differences in: angle, speed, rate, direction, direction of motion, output, force, moment, inertia, mass, balance, application of comparable things, etc.

Differential and differentially are defined within this document as unequal, off center and/or involving differences in the angle, speed, rate, direction, direction of motion, output, force, moment, inertia, mass, balance, application of comparable forces, etc.

Dynamic and dynamically may be defined as the immediate action that takes place at the moment they are needed. Immediate, in this application, means that the control action occurs in a manner that is responsive to the extent that it prevents or mitigates vessel motions and attitudes before they would otherwise occur in the uncontrolled situation. Someone skilled in the art understands the relationship between sensed motion parameters and required effector response in terms of the maximum overall delay that can exist while still achieving the control objectives. Dynamic may be used in describing interactive hardware and software systems involving differing forces and may be characterized by continuous change and/or activity. Dynamic may also be used when describing the interaction between a vessel and the environment. As stated above, marine vessels may be subject to various dynamic forces generated by its propulsion system as well as the environment in which it operates.

Figure 1:
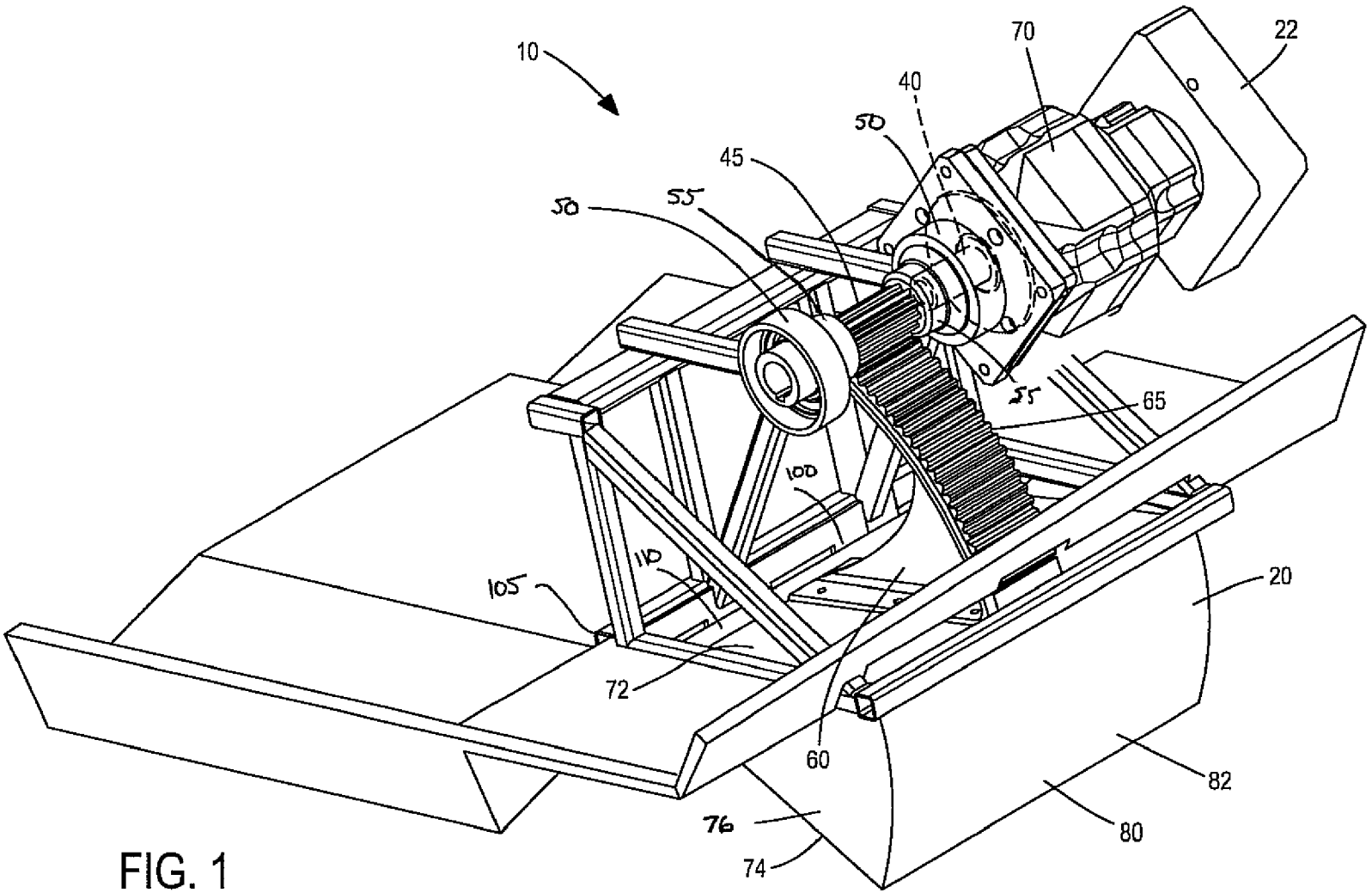
FIG. 1 is a partial perspective view of a trim tab assembly for a watercraft having a trim tab in a deployed position.

A vessel attitude may be defined as relative to three rotational axes, as detailed in FIG. 1 including pitch attitude or rotation about the Y, transverse or sway axis, roll attitude or rotation about the X, longitudinal or surge axis, and yaw attitude or rotation about the Z, vertical or heave axis.

Someone skilled in the art understands that active marine vessel damping is the attenuation of the value of a resonant response, such as the pitch, roll and yaw of the vessel. Someone skilled in the art understands that a marine vessel active stabilization, motion damping and attitude control system is a system selected, sized and integrated, based on a vessel's specific design, to achieve the effector rates required for damping pitch and/or roll and/or yaw.

Someone skilled in the art understands, for motion damping to be achieved, effector angular motion rates may generally be at least 10 times the vessel angular motion rate in the pitch and roll axis. For example, angular motion rates of 4 degrees per second may be typical of conventional high performance planing craft. This means that effector angular motion rates of 40 degrees per second may be used to achieve motion damping for this specific performance class of planing craft.

Someone skilled in the art understands, a hydrofoil, planing device and/or interceptor produces control forces based on a speed-squared relationship and are therefore much more effective at higher speeds than lower speeds. For example, a trim tab produces 4 times the amount of force at 20 knots than it does at 10 knots.

Figure 3:
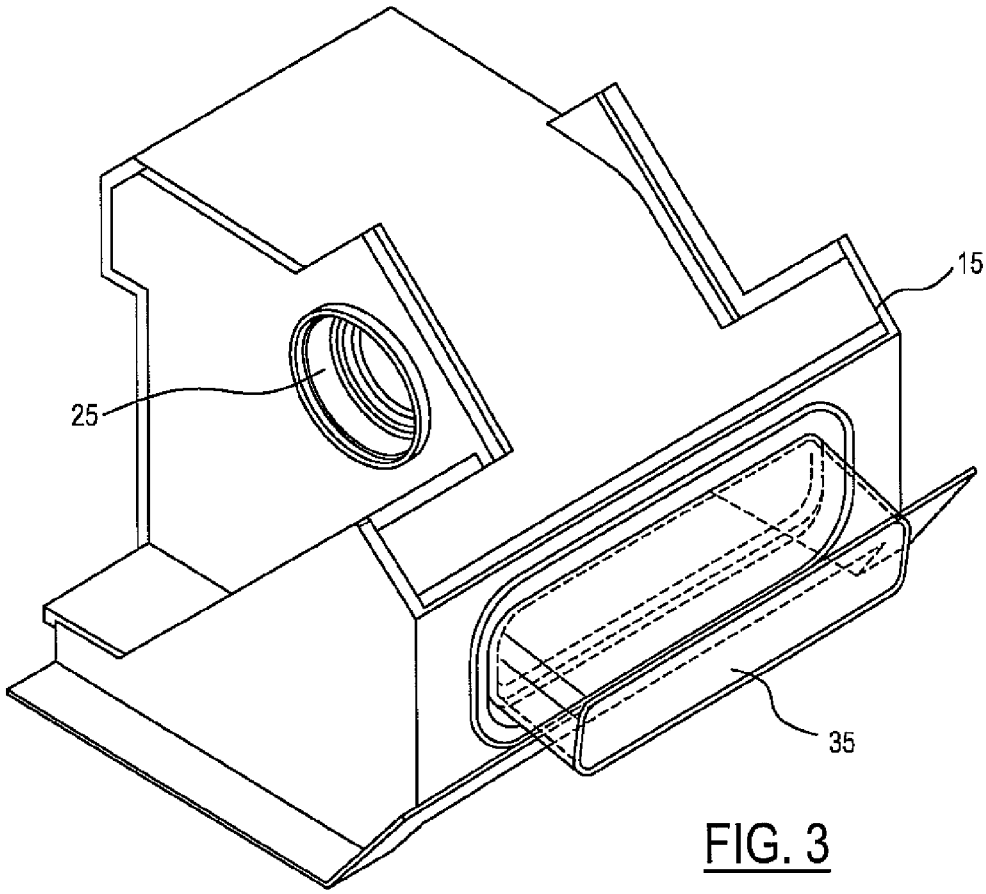
FIG. 3 is a perspective view of a enclosure for a trim tab assembly for a watercraft.
Figure 4:
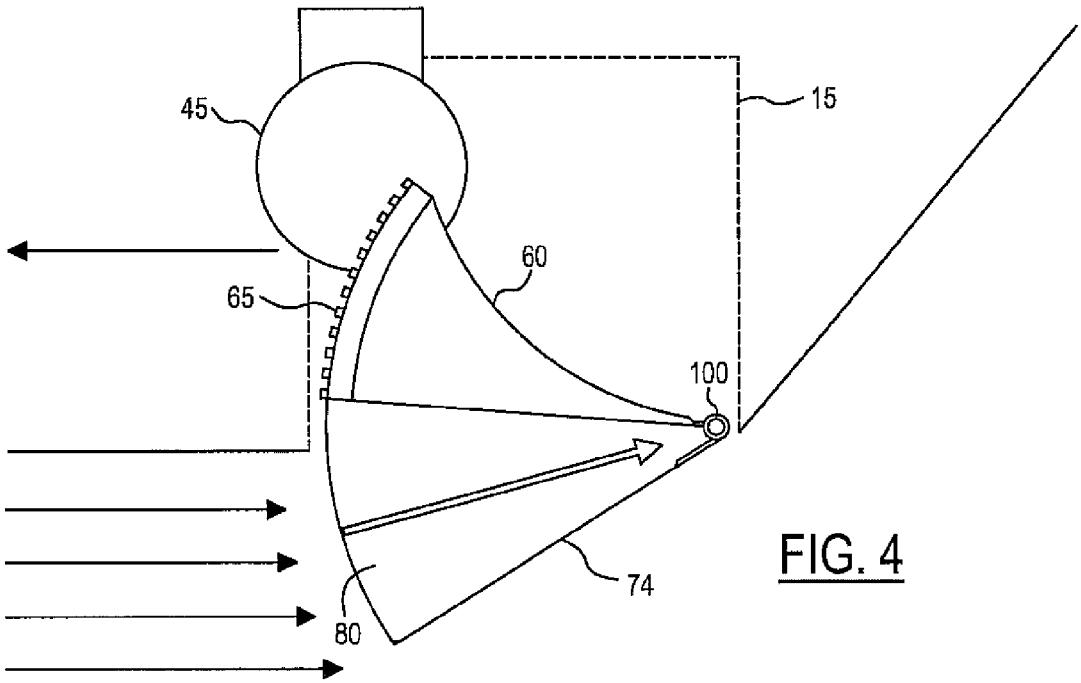
FIG. 4 is a view of an alternate embodiment of a trim tab assembly with a forward facing curved leading edge and its hinge placed aft.

Referring to the figures, there is shown a trim tab assembly 10 for a watercraft. The trim tab assembly 10 may include a enclosure 15 or shell structure, as best shown in FIG. 3. The enclosure 15 may be linked with or joined with a support structure 30, to form a module that may be positioned within a hole formed in a watercraft. Alternatively, the enclosure 15 may be an opening formed within the hull in which the support structure 30 is disposed. Alternatively, the tab assembly 10 may be modular within a self-contained structure that may be attached to a vessel. At least one trim tab 20 is disposed within the enclosure 15. An electric actuator 22 may be linked with the trim tab 20 pivotally moving the trim tab 20 relative to the enclosure 15. The electric actuator 22 may be positioned on a dry side not exposed to water relative to the enclosure 15.

Referring to FIG. 3, there is shown one embodiment of a enclosure 15 for use in the trim tab assembly 10. As can be seen in the figure, the enclosure 15 is sized and shaped to accommodate the trim tab assembly 10. The enclosure 15 may include holes 25 formed therein for accommodating various components of the trim tab assembly 10, as will be discussed in more detail below. Additionally, the enclosure 15 may also include a pressure relief orifice 35 formed therein that allows for release of air and water pressure created by movement of the trim tab 20 within the enclosure 15 during actuation.

Referring to the figures, the trim tab assembly 10 may include an electric actuator 22 having a driveshaft 40 that is connected to a drive gear 45. At least one bearing 50 supports the driveshaft 40 in the support structure 30. In one aspect, the at least one bearing 50 includes a seal 55 preventing water disposed within the enclosure 15 from exiting the cavity 15. Additionally, the seal 55 isolates the electric actuator 22 that is positioned on a dry side of the enclosure 15 from the water. A position sensor 89 best seen in FIGS. 10, 11 and 12-16 may be attached to the drive shaft 40 to monitor a position of the trim tab 20 relative to the enclosure 15. The position sensor 89 may include a potentiometer or equivalent device used to communicate position data to a central control computer. Alternatively, the electric actuator 22 may include a position sensor integrated with the motor.

Again referring to figures, the trim tab assembly 10 may include a driven member 60 that is attached to the trim tab 20 and is operably linked with the drive gear 45. In one aspect, the driven member 60 may include a flexible gear portion 65 attached to the driven member 60 and is meshed with the drive gear 45. In one aspect, the interface between the drive gear 45 and driven member 60 is a soft interface such that the gear teeth of the flexible gear portion 65 will shear upon application of a predetermined force preventing damage to a gearbox 70 of the electric actuator 22 as well as the driveshaft 40 and enclosure 15. It should be realized that the gear box may be eliminated as a separate component and may be integrated with the electric actuator 22. Additionally, the soft interface provides a joining of the drive gear 45 and driven member 60 without the need for lubrication. Such a dry relationship is advantageous when used in a wet environment within the enclosure 15.

Figure 9:
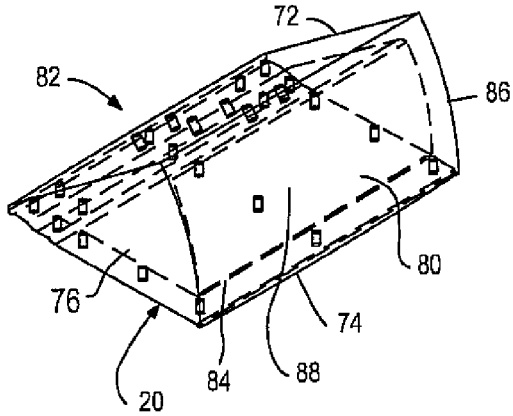
FIG. 9 is a view of the trim tab
Figure 10:
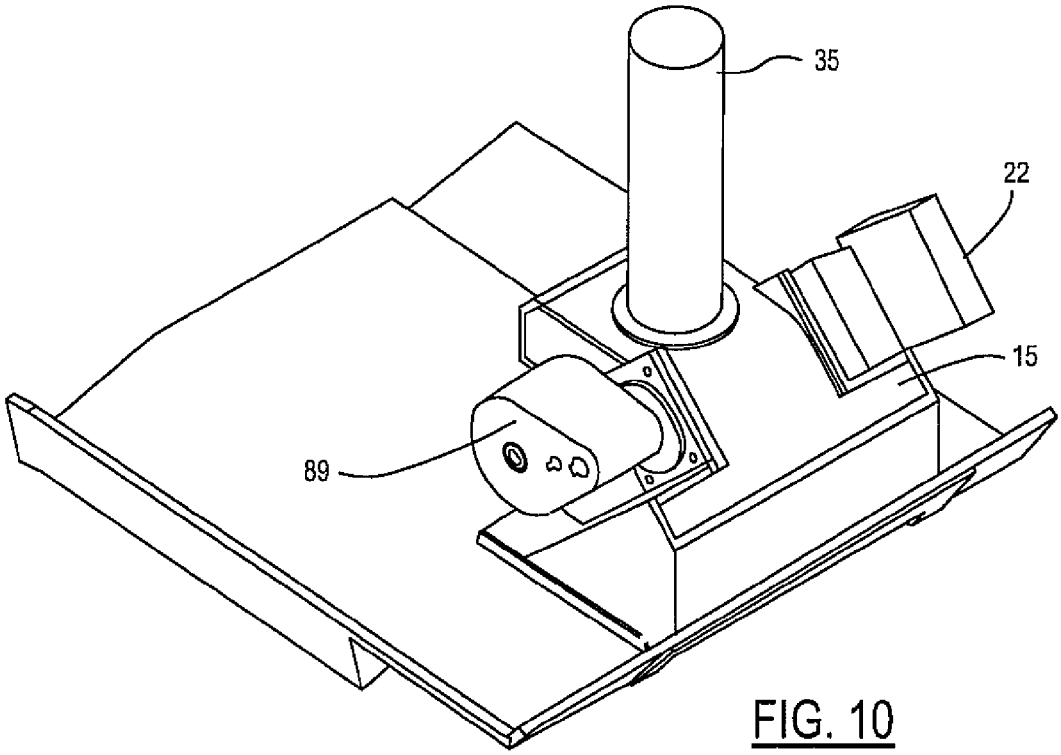
FIG. 10 is an alternate embodiment of a enclosure having a pressure relief orifice.
Figure 11:
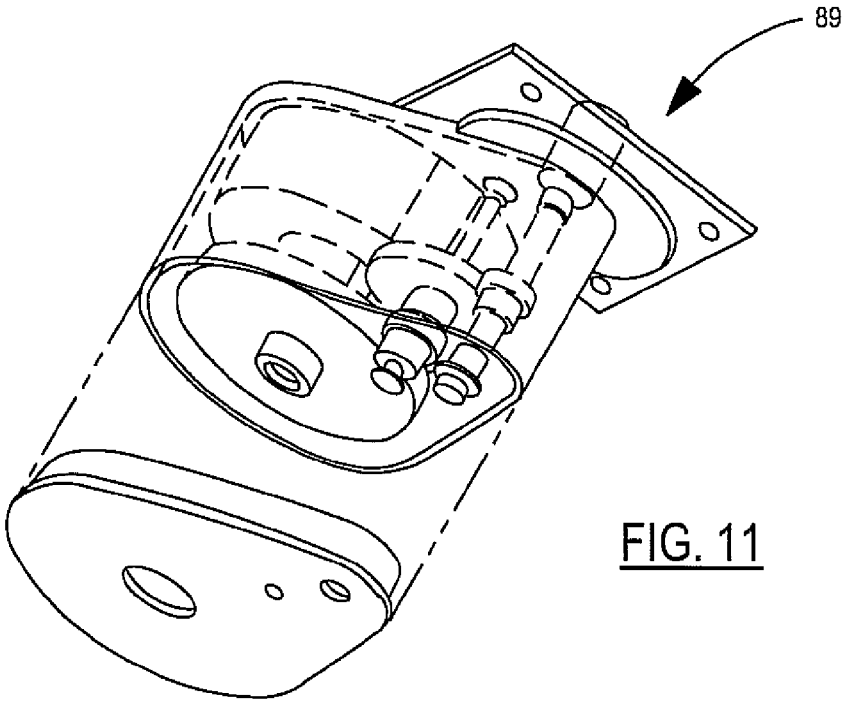
FIG. 11 is a view of a position sensor.
Figure 12:
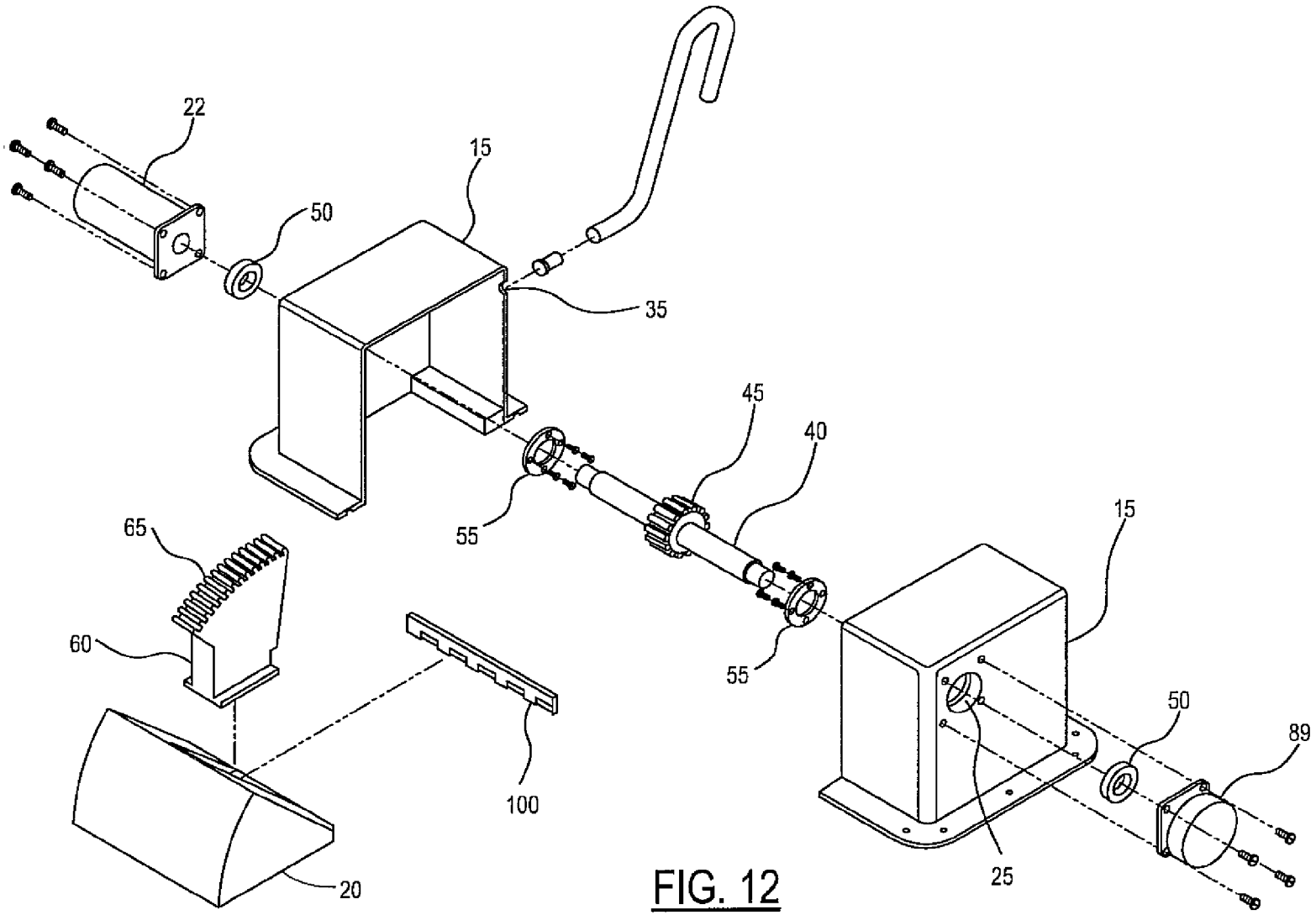
FIG. 12 is an exploded perspective view of the alternate embodiment of FIG. 4.
Figure 13:
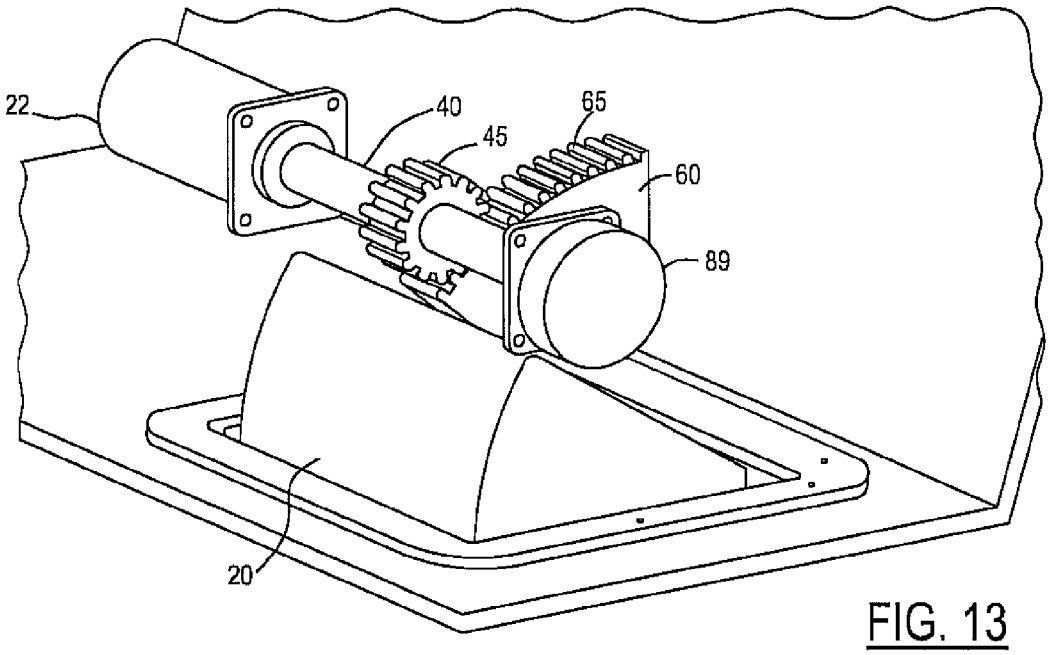
FIG. 13 is a perspective view of the alternate embodiment of FIG. 12 with the tab in the non deployed position.
Figure 14:
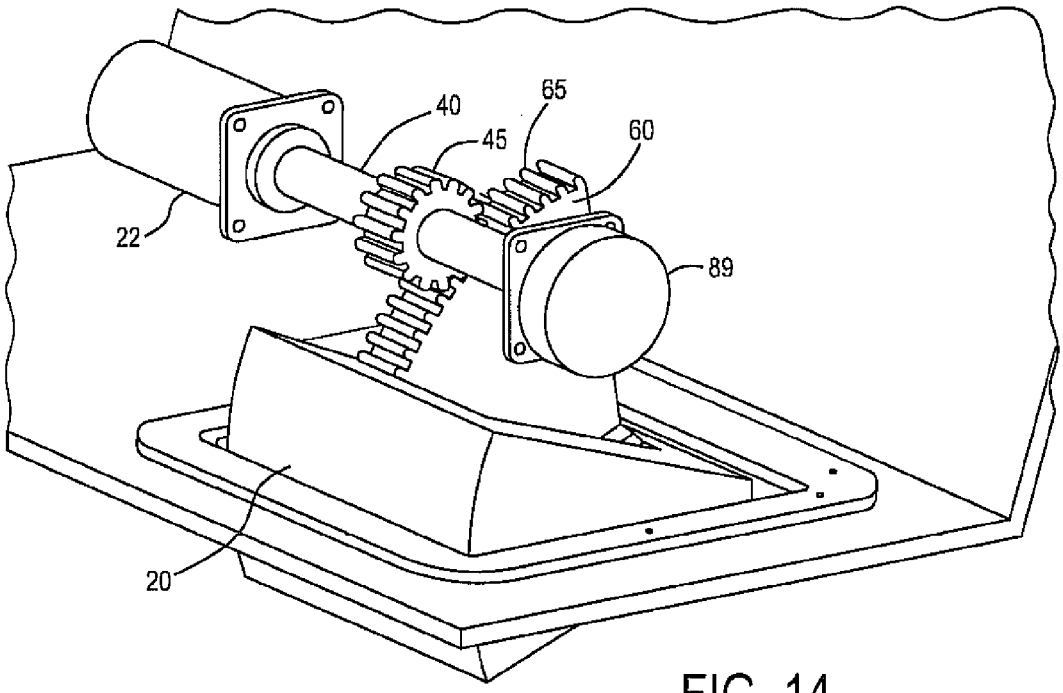
FIG. 14 is a perspective view of the alternate embodiment of FIG. 12 with the tab in an intermediate position.
Figure 15:
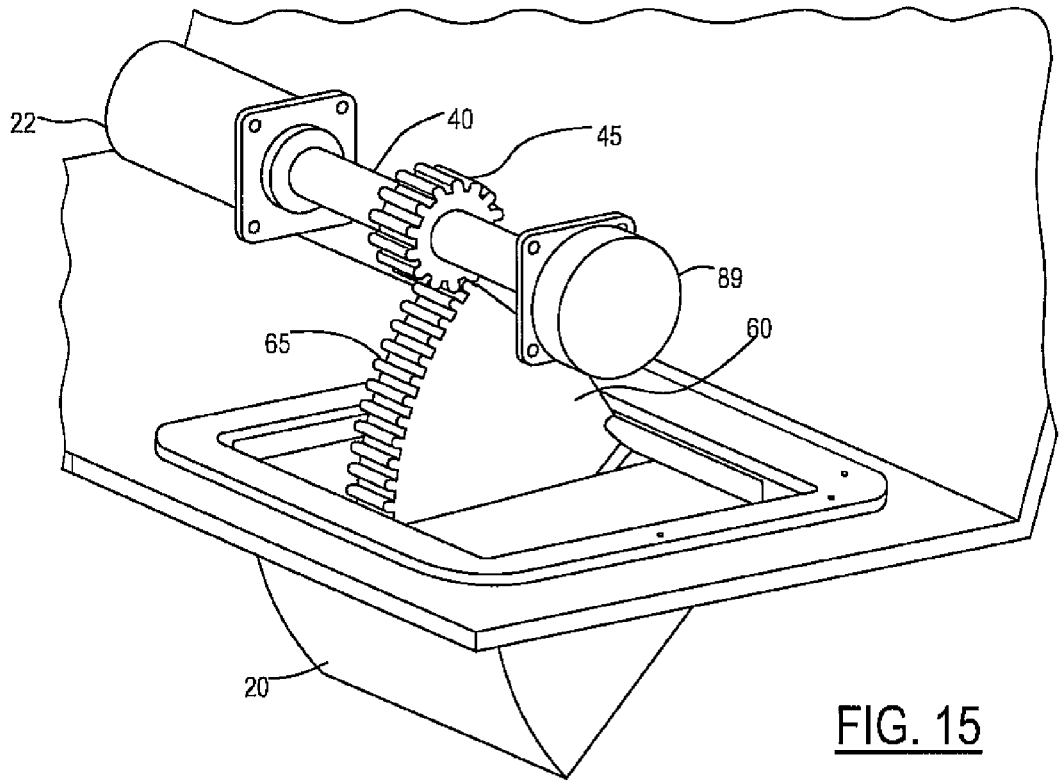
FIG. 15 is a perspective view of the alternate embodiment of FIG. 12 with the tab in the fully deployed position.
Figure 16:
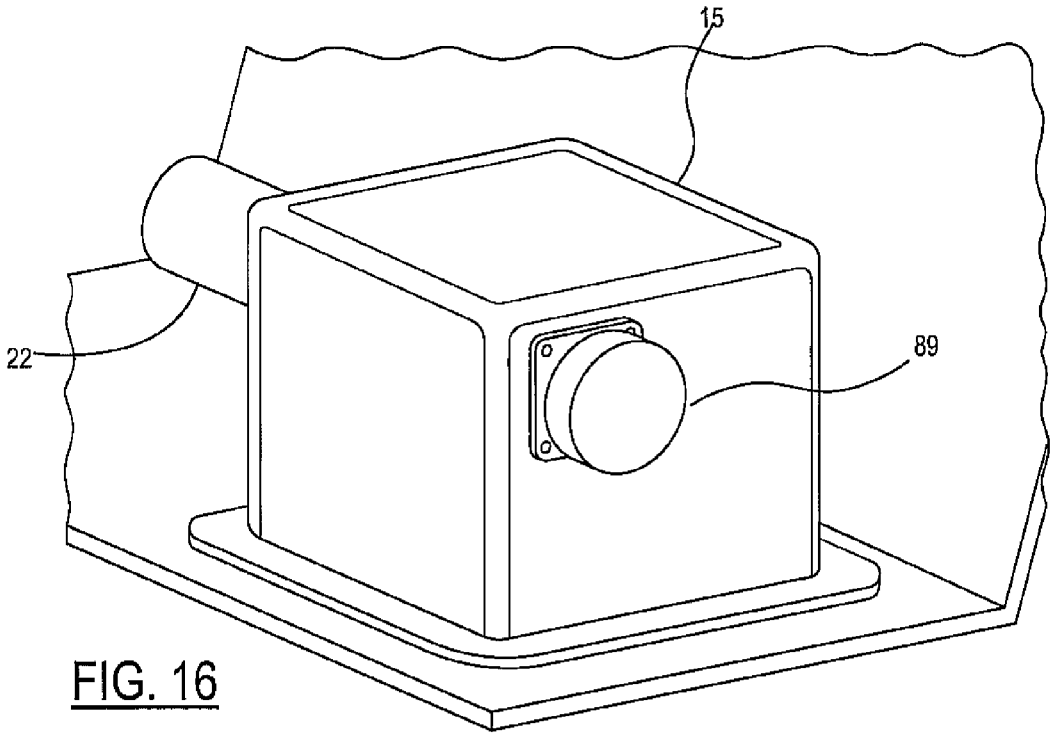
FIG. 16 is a perspective view of the alternate embodiment of FIG. 12 with the enclosure shown.

Referring to the various figures, in one aspect the trim tab 20 may include a generally planar top 72, bottom 74, and side 76 surfaces linked by a curved trailing surface 80 defining a wedge-shaped body 82. In one aspect, as best seen in FIG. 9, the trim tab 20 may include an inner support structure 84 surrounded by an outer skin 86. In one aspect, the wedge shaped body 82 may include a buoyant material positioned within an interior 88 of the wedge-shaped body 82 providing support for the outer skin 86 as well as decreasing an overall weight of the trim tab 20. Various materials such as closed and open cell foams may be used in conjunction with additional support structure to withstand loads applied to a trim tab 20 during actuation and to provide buoyancy.

Figure 5:
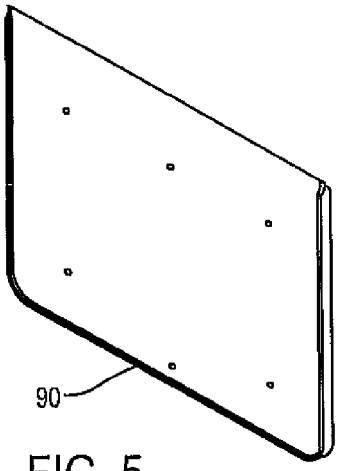
FIG. 5 is a view of a removable plate for attaching to a bottom surface of a trim tab.

In another aspect, and as shown in FIG. 5, a removable plate 90 may be attached to a water contacting surface of the trim tab 20. The removable plate 90 may include characteristics for modifying the performance characteristics of the trim tab 20. For example, the removable plate 90 may have various characteristics including concave shapes, convex shapes, and strakes of varying dimension and position, as well as shape surfaces that match the contour of a watercraft hull. In this manner, the removable plate 90 may be tailored to provide various design and performance characteristics that affect the overall performance of a watercraft having a trim tab assembly 10. Additionally, the removable plate 90 can be swapped out with another plate to provide various configurations that may be interchangeable to affect the performance of a watercraft.

Figure 2:
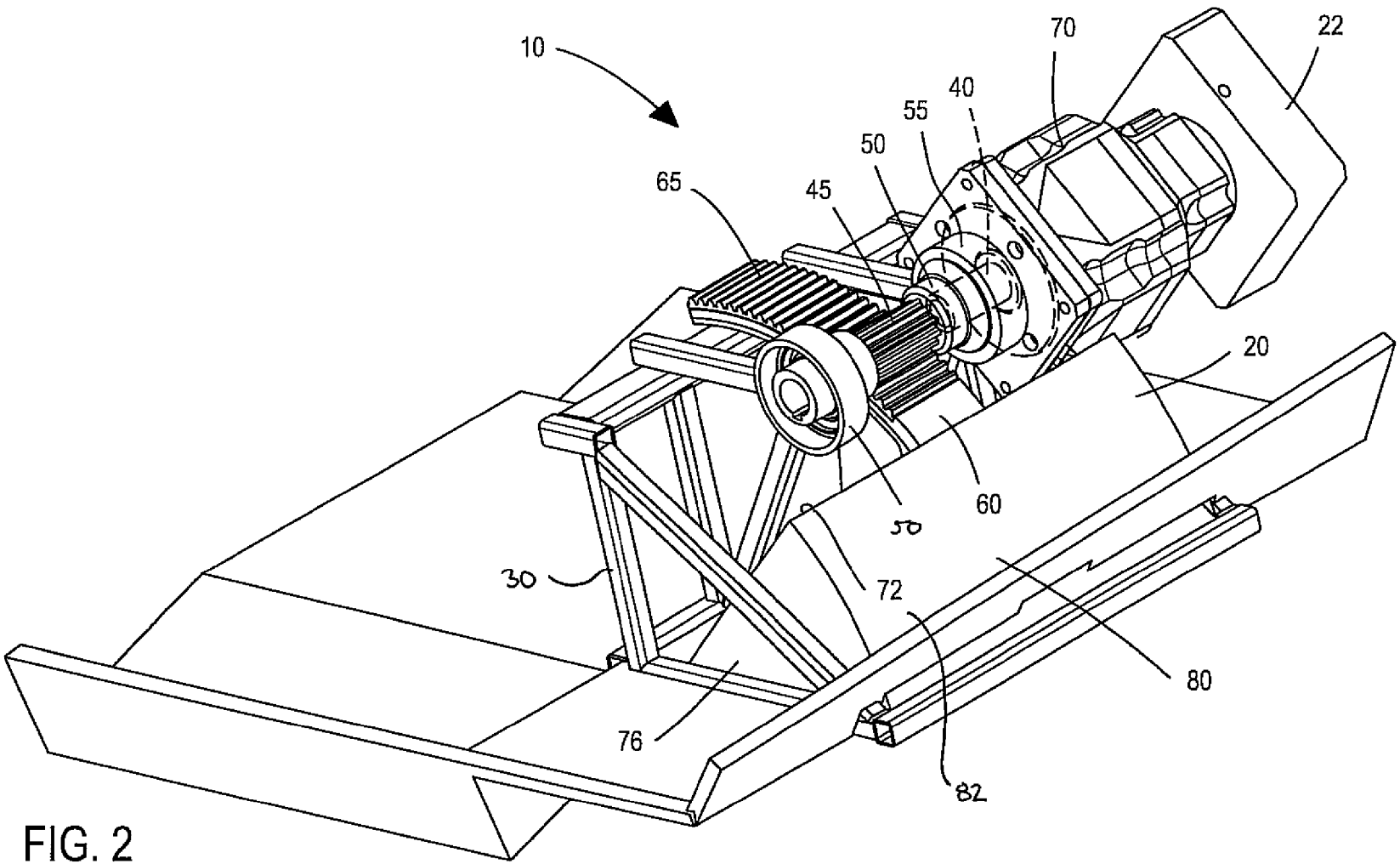
FIG. 2 is a partial perspective view of a trim tab assembly for a watercraft having a trim tab in a stowed position.
Figure 6:
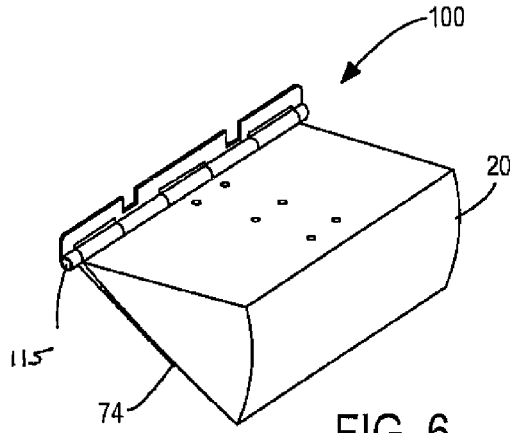
FIG. 6 is a view of the trim tab and hinge assembly.
Figure 7:
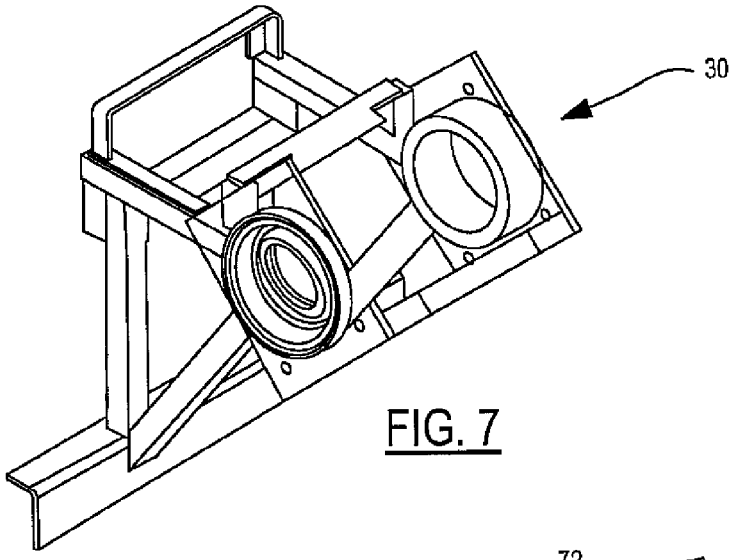
FIG. 7 is a view of the support structure.
Figure 8:
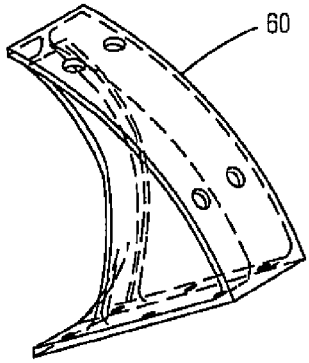
FIG. 8 is a view of the driven member.

Referring to FIGS. 1, 2 and 6, the trim tab assembly 10 may include a hinge assembly 100 that is linked to the enclosure 15 and the trim tab 20 for pivotal movement of the trim tab 20 relative to the enclosure 15. As shown in FIGS. 1 and 2, the hinge assembly 100 may be positioned on a forward edge 105 of the enclosure 15 and linked with a forward portion 110 of the trim tab 20. In one aspect, the hinge assembly 100 may be in two pieces such that one piece is attached to a bottom surface 74 of the trim tab 20 at the forward edge 110 and is mated with a second piece attached to the support structure 30 disposed within the enclosure 15. A hinge pin 115 may be positioned along a center line of the hinge allowing pivotal movement of the trim tab 20 relative to the support structure 30 and enclosure 15.

In one aspect, the trim tab 20 may be positioned within the enclosure 15 in a close tolerance relationship preventing high pressure water created during tab deflection or extension from entering the enclosure 15. In this manner, high pressure water is prevented from contacting a low pressure top surface 72 of the trim tab 20 that is disposed within the enclosure 15. In one aspect, the trim tab 20 remains at least partially within the enclosure 15 when fully deployed to prevent foreign objects from entering the enclosure 15.

In use, the trim tab 20 is pivotally movable within the enclosure 15 to apply deflection forces to the water or obstruction of the water on which a watercraft is traveling to affect the performance of the watercraft. In one aspect, the trim tab 20 is actuated at speeds sufficient to counter motion rates and dampen motion in a pitch, steer and yaw axis of the watercraft. In one aspect, the trim tab 20 is actuated to control attitude changes in a pitch, steer and yaw axis of the watercraft.

In one aspect, the watercraft may include at least two trim tab assemblies 10 positioned within the watercraft. The trim tab assemblies 10 may be actuated in series, meaning that the at least two trim tab assemblies 10 actuate in the same manner at a given time. Alternatively, the at least two trim tab assemblies 10 may be actuated differentially wherein actuation of one of the trim tabs 20 is not the same as another to affect various forces on the watercraft to control the attitude, motion and dampen motion in the axes, as described above.

Referring to FIGS. 4 and 12-16, there is shown an alternate embodiment of a trim tab assembly 10 including the same components described above except that the curved surface 80 of the trim tab 20 is positioned within the enclosure 15 in a forward facing position relative to the watercraft. Additionally, the hinge assembly 100, as described above, would be positioned at a rear edge 102 of the bottom surface 74 of the trim tab 20 and a rear 104 of the support structure 30 disposed within the enclosure 15. In this embodiment, the curved surface 80 contacts the water when actuated applying a force to the water and affecting a performance characteristic of a watercraft. In this position, the force needed to actuate the trim tab 20 is decreased in relation to the previously described first embodiment.

The invention claimed is:

1. A trim tab assembly for a watercraft comprising:

an enclosure having an interior and an exterior;

at least one trim tab disposed in the interior of the enclosure;

an electric actuator connected to the trim tab pivotally moving the trim tab, the electric actuator positioned on the exterior of the enclosure, wherein the electric actuator includes a drive shaft connected to a drive gear and a driven member attached to the trim tab, the driven member operably connected with the drive gear wherein the driven member includes a gear portion meshed with the drive gear; and at least one bearing supporting the drive shaft and a seal on the at least one bearing wherein water in the interior of the enclosure is sealed within the enclosure.

2. The trim tab assembly of claim 1 wherein the trim tab includes inner support structures surrounded by an outer skin.

3. The trim tab assembly of claim 1 wherein the trim tab includes a generally planar top, bottom, side and front surfaces connected by a curved surface defining a wedge.

4. The trim tab assembly of claim 1 including a hinge assembly connected to the enclosure and the trim tab for pivotally connecting the trim tab to the enclosure.

5. The trim tab assembly of claim 1 including a rotary position sensor attached to the drive shaft on the exterior of the enclosure.

6. The trim tab assembly of claim 1 including an opening in the enclosure for equalizing a pressure within the cavity.

7. The trim tab assembly of claim 1 including a removable plate attached to a water contacting surface of the trim tab, the removable plate including a concave surface, or a convex surface, or strakes for modifying performance characteristics of the trim tab.

8. The trim tab assembly of claim 1 wherein the tab is positioned within the enclosure such that water during tab deflection is prevented from entering the enclosure.

9. The trim tab assembly of claim 1 wherein the trim tab remains at least partially within the enclosure when fully deployed preventing foreign objects from entering the enclosure.

10. The trim tab assembly of claim 1 wherein the interface between the drive gear and driven member requires no lubrication wherein gear teeth of the driven member will shear upon application of a predetermined force preventing damage to the actuator, driveshaft and enclosure.

11. The trim tab assembly of claim 3 wherein the wedge includes a buoyant material positioned within an interior of the wedge.

12. The trim tab assembly of claim 1 wherein the trim tab is actuated countering motion rates and damping motion in the pitch, steer and yaw axes of a vessel.

13. The trim tab assembly of claim 1 wherein the water craft includes at least two trim tab assemblies wherein each the trim tab assemblies are actuated together or separately.

14. The trim tab assembly of claim 1 wherein the trim tab is actuated to control attitude changes in a pitch, steer and yaw axis of the watercraft.

15. The trim tab assembly of claim 3 wherein the curved surface is positioned within the enclosure in a forward facing position wherein the curved surface contacts water when actuated.

16. A trim tab assembly for a watercraft comprising:

an enclosure having an interior and an exterior;

at least one trim tab disposed in the interior of the enclosure wherein the trim tab includes a generally planar top, bottom, side and front surfaces connected by a curved surface defining a wedge wherein the wedge includes a buoyant material positioned within an interior of the wedge;

an electric actuator connected to the trim tab pivotally moving the trim tab, the electric actuator positioned on the exterior of the enclosure, wherein the electric actuator includes a drive shaft connected to a drive gear and a driven member attached to the trim tab, the driven member operably connected with the drive gear wherein the driven member includes a gear portion meshed with the drive gear.

* * * * *